US005884449A

United States Patent [19]

Alderman et al.

[11] Patent Number: 5,884,449

[45] Date of Patent: Mar. 23, 1999

[54] WIND PROTECTION FOR APPARATUS FOR PAYING OUT AN INSULATION SUPPORT SHEET

[75] Inventors: Robert J. Alderman, San Antonio; James E. Taylor, Seguin, both of Tex.; Dennis K. Wenrick, Oviedo, Fla.

[73] Assignee: Owens Corning Fiberglas Technology, Inc., Summit, Ill.

[21] Appl. No.: 536,542

[22] Filed: Sep. 29, 1995

[51] Int. Cl.[6] ..... E04B 1/74; E04G 23/03

[52] U.S. Cl. ..... 52/746.11; 52/749.12; 52/407.4; 242/557; 242/610.3

[58] Field of Search ..... 52/746.11, 749.1, 52/749.12, 407.4, 407.5, 359; 242/557, 598, 610.3, 548

[56] References Cited

U.S. PATENT DOCUMENTS

| | | | |
|---|---|---|---|
| 3,559,914 | 2/1971 | Alderman . | |
| 3,969,863 | 7/1976 | Alderman . | |
| 4,047,345 | 9/1977 | Alderman | 52/746.11 X |
| 4,047,346 | 9/1977 | Alderman | 52/746.11 X |
| 4,068,446 | 1/1978 | Brueske | 52/746.11 X |
| 4,075,807 | 2/1978 | Alderman | 52/746.11 X |
| 4,147,003 | 4/1979 | Alderman . | |
| 4,222,212 | 9/1980 | Alderman . | |
| 4,967,535 | 11/1990 | Alderman | 52/746.11 X |

*Primary Examiner*—Winnie S. Yip

*Attorney, Agent, or Firm*—C. Michael Gegenheimer; Curtis B. Brueske

[57] ABSTRACT

A method for providing a roof structure of the type having a plurality of purlins spaced apart from one another in a parallel arrangement is disclosed. A first section of the roof structure, which includes purlins, a support sheet, insulation material, and hard roofing material, is completed. A carriage is then moved in a first direction along the length of the purlins and away from the first section of the roof structure to define a gap between the completed first section and the carriage. The movement of the carriage pays out a support sheet from the carriage so that the support sheet depends from adjacent purlins in the gap. A wind barrier, which is in a generally horizontal position to prevent wind from blowing vertically through the gap, is provided, thereby hindering wind disturbance of the support sheet.

23 Claims, 4 Drawing Sheets

WIND PROTECTION FOR APPARATUS FOR PAYING OUT AN INSULATION SUPPORT SHEET

TECHNICAL FIELD

This invention relates to the construction of an insulated metal roof structure for use in commercial and industrial buildings.

BACKGROUND ART

Metal roof structures typically comprise a series of parallel rafter beams extending across the building in one direction and purlin beams parallel to each other mounted on top of the rafters extending in a direction normal to the rafters. The purlins are often joined together by support bracing or straps for extra support. Insulation material in long sheets is placed in the area between purlins. The sheets of insulation material can be laid along the length of the purlins or across the purlins in a direction normal to the purlins. Hard roofing material such as metal decking is then attached on top of the purlins over the insulation material. Because the hard roofing material comes in long sheets and the roofs generally have two sloped sections, it is customary to construct along the width of the sloped section and then proceed along the length of the structure from one end to the other. The workers stand on the previously laid section of roof to construct the next section.

The insulation material must be supported between the purlins, and various methods of support have been used. Mounting straps or wire mesh that are attached to the purlins by forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is required.

Some systems dispense with the lattice and use the sheet itself to support the insulation material. The support sheet is draped from the adjacent purlins and the insulation material is placed on top of the support sheet. A carriage is used to aid in the dispensing of the support sheet. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins the support sheet is draped across the purlins.

Wind can hinder or even prevent the workers from building the roof structure because of the handling of the large strips of insulation and roof decking. Because the roof is elevated from the ground level, the velocity of wind is generally greater and can cause problems for the workers constructing the roof. Even light winds which blow across or through the purlin support structure can disturb the insulation by causing the insulation material to lift up or shift positions after the workers have laid the insulation down in its proper installation position. For strong winds, it can be nearly impossible to handle the insulation and keep it in position before the hard roofing material is attached to the purlins.

Strong winds are also a safety concern for the workers on the top of the roof structure. A known safety feature for workers constructing a purlin type roof structure is to provide a platform which is movable along the tops of the purlins and which provides fall protection for the workers to prevent them from falling off the leading edge of the previously completed section of roof.

It would be desirable to have a method of building a roof structure which provides for wind protection and which is convenient and efficient.

DISCLOSURE OF INVENTION

There has now been invented an improved method of building a roof structure which is both convenient and efficient, and provides for wind protection to hinder wind disturbance of insulation material and a support sheet.

The present invention provides for a roof structure of the type having a plurality of purlins spaced apart from one another in a parallel arrangement, and in which the method includes completing a first section of the roof structure comprising purlins, a support sheet, insulation material, and hard roofing material. A carriage is moved in a first direction along the length of the purlins and away from the first section of the roof structure, thereby defining a gap between the completed first section and the carriage. The movement of the carriage pays out a support sheet from the carriage so that the support sheet depends from adjacent purlins in the gap. A wind barrier is provided which is in a generally horizontal position to prevent wind from blowing vertically through the gap, thereby hindering wind disturbance of the support sheet. Insulation material can be applied above the support sheet, in the gap. The wind barrier is sufficient to hinder wind disturbance of the insulation material. The insulation can be laid laterally across the purlins or can be applied from a dispenser in a direction parallel to the purlins. The wind barrier is preferably attached to the carriage and positioned either above or underneath the payed out support sheet. The wind barrier may also include rollers which roll along the top of the purlins. Preferably, the wind barrier is also sufficient for fall protection.

In a specific embodiment of the invention, a first layer of insulation material is applied parallel to the purlins, above the support sheet, and in the gap, and a second layer of insulation material is applied on top of the first layer of insulation material, where the wind barrier is sufficient to hinder wind disturbance of the insulation material.

In another specific embodiment of the invention, the carriage has a plurality of carriage sections and support sheets, where the support sheets are payed out downwardly from dispensers mounted on the carriages and positioned substantially above the purlins to define a vertical space between the dispensers and the purlins, thereby forming vertical portions in the support sheets. The vertical portions of the support sheets from adjacent dispensers are aligned to prevent wind from blowing horizontally in a direction along the length of the purlins through the vertical space. The support sheets are then fed around turning bars positioned near the bottom of the vertical space to turn the support sheets in a generally horizontal direction. Insulation material is then applied above the horizontal portions of the support sheets, and the vertical portions of the support sheets are sufficient to hinder wind disturbance of the insulation material. Preferably the adjacent turning bars on adjacent carriage sections are generally co-linear on centers, or spaced apart from each other by a distance less than about 3 inches. Preferably, the support sheets are fed or deflected around deflection bars which are positioned near the top of the vertical space, between the dispensers and the turning bars, to align the vertical portions of adjacent support sheets in a generally co-planar orientation. The plurality of carriage sections can be moved together in unison in the first direction.

BEST MODE FOR CARRYING OUT THE INVENTION

Figure 1:
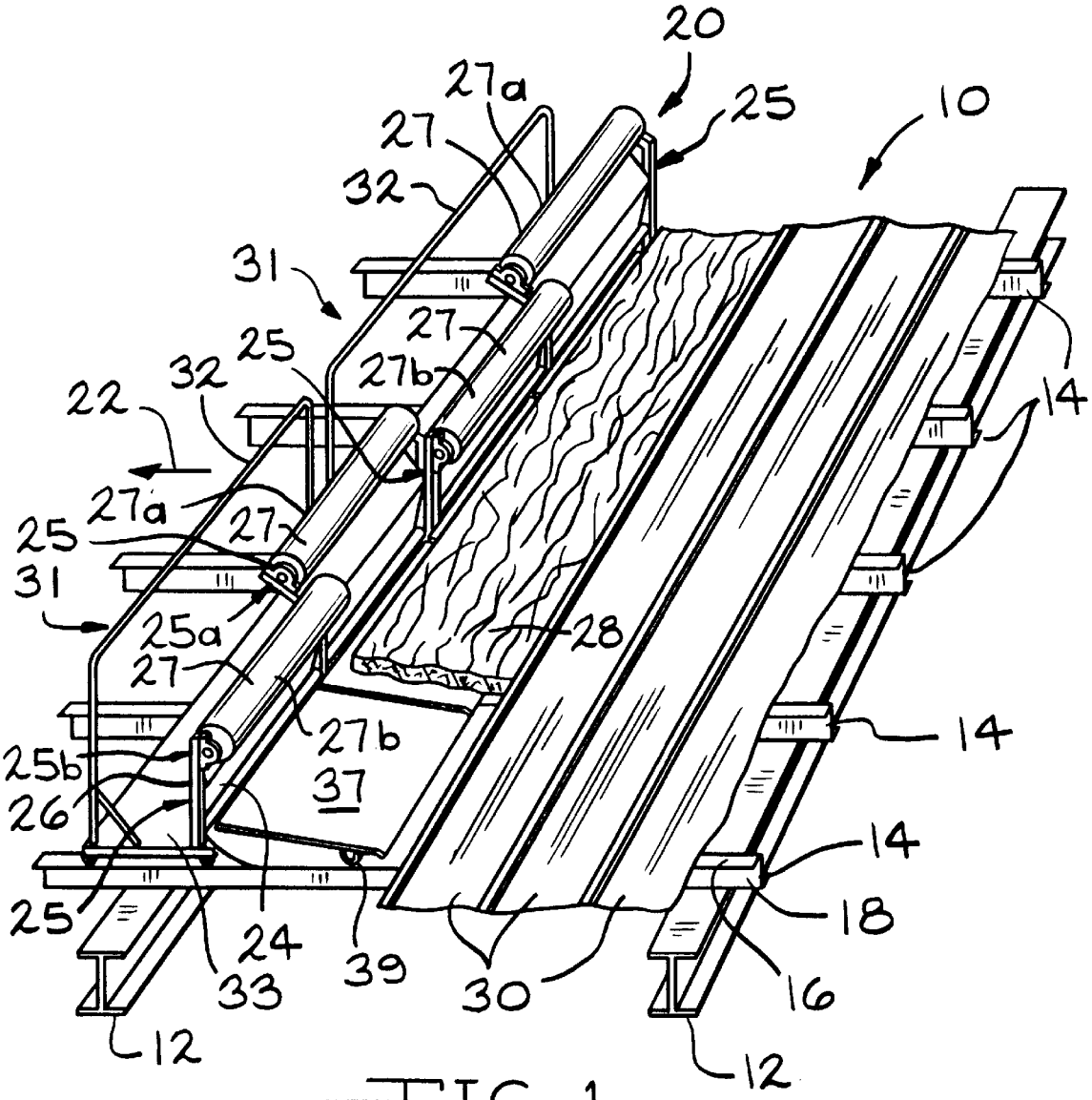
FIG. 1 is perspective view of the carriage on top of a roof structure of the present invention.

There is illustrated in FIG. 1 a building roof structure generally indicated at 10. The roof structure is typically supported by main rafter beams 12 which are positioned parallel to each other. A plurality of purlins 14, spaced apart and arranged parallel to each other, are fastened on top of the rafters in a direction normal to the rafters. The purlins have a generally Z-shaped cross-section and include a top portion 16 and a vertical portion 18. The spacing of the purlins is typically 5 feet on centers. Roof structures may also be constructed from bar joists or trusses, and the invention as described herein will work equally well with purlins, bar joists or trusses. The use of the term "purlins" in this specification and claims includes not only traditional purlins, but also bar joists and trusses and other similar structural members.

Broadly stated, the roof structure is constructed by use of a carriage 20 that rides on top of the purlins and travels in a first direction 22 along the length of the purlins. As the carriage is moved, a support sheet 24 is payed out from a dispenser 25 mounted on the carriage. The dispenser comprises generally vertical members 26 and a roll 27 of support sheet material. The roll is rotatably mounted on the vertical members. The carriage can be any suitable apparatus that rides along the top of the purlins for dispensing the support sheet. The support sheet is draped on top of adjacent parallel purlins so that the support sheet depends from the top portions 16 of the purlins. The support sheet supports a layer of insulation material 28 that is placed on top of the support sheet between the adjacent purlins. The insulation material can be laid laterally across the purlins or in a direction parallel to the purlins. Long sheets of hard roofing material 30 such as metal roof decking are then attached to the top portion of the purlins over the support sheet and insulation. The attachment of the hard roofing material presses down on the edges of the portion of the support sheet that is directly underneath so that the support sheet supports the insulation between the purlins.

Because the hard roofing material comes in long sheets, typically 30 to 35 feet, and the roofs generally have two sloped sections, it is customary to construct along the width of the sloped section and then proceed along the length of the structure from one end to the other. The workers stand on the previously attached hard roofing material to assemble the next section of roof. The carriage travels along the length of the purlins and is moved by the workers as each section of roof is assembled.

Preferably, the carriage is comprised of a plurality of carriage sections 31, two of which are shown in FIG. 1. The carriage sections can be joined together so that they span the entire width of the sloped section of the roof. The carriage is then propelled across the purlins by pulling means (not shown) in the first direction so that all the carriage sections move in unison. Each carriage includes safety handrails 32 and a worker's platform 33 for the worker to stand on while operating or moving the carriage. Because the support sheet is draped across adjacent purlins, the width of the support sheet is wider than the distance between the purlins. Purlins that are spaced apart 5 feet on centers have about a 57 inch space between adjacent purlins. A support sheet for use on such a purlin spacing will have a width that is typically within a range of about 66 to 70 inches. Therefore, adjacent support sheet rolls 27 are not co-linear and must be slightly staggered. Preferably, each carriage section has a leading dispenser 25*a* which includes a leading support sheet roll 27*a*, and a trailing dispenser 25*b* which includes a trailing support sheet roll 27*b*. The support sheet dispensed from the trailing dispenser will be draped on top of the support sheet from the leading dispenser as the carriage travels in the first direction. Multiple carriage sections having a leading and trailing dispenser can, therefore, be joined together, with every dispenser being staggered from an adjacent dispenser.

Figure 2:
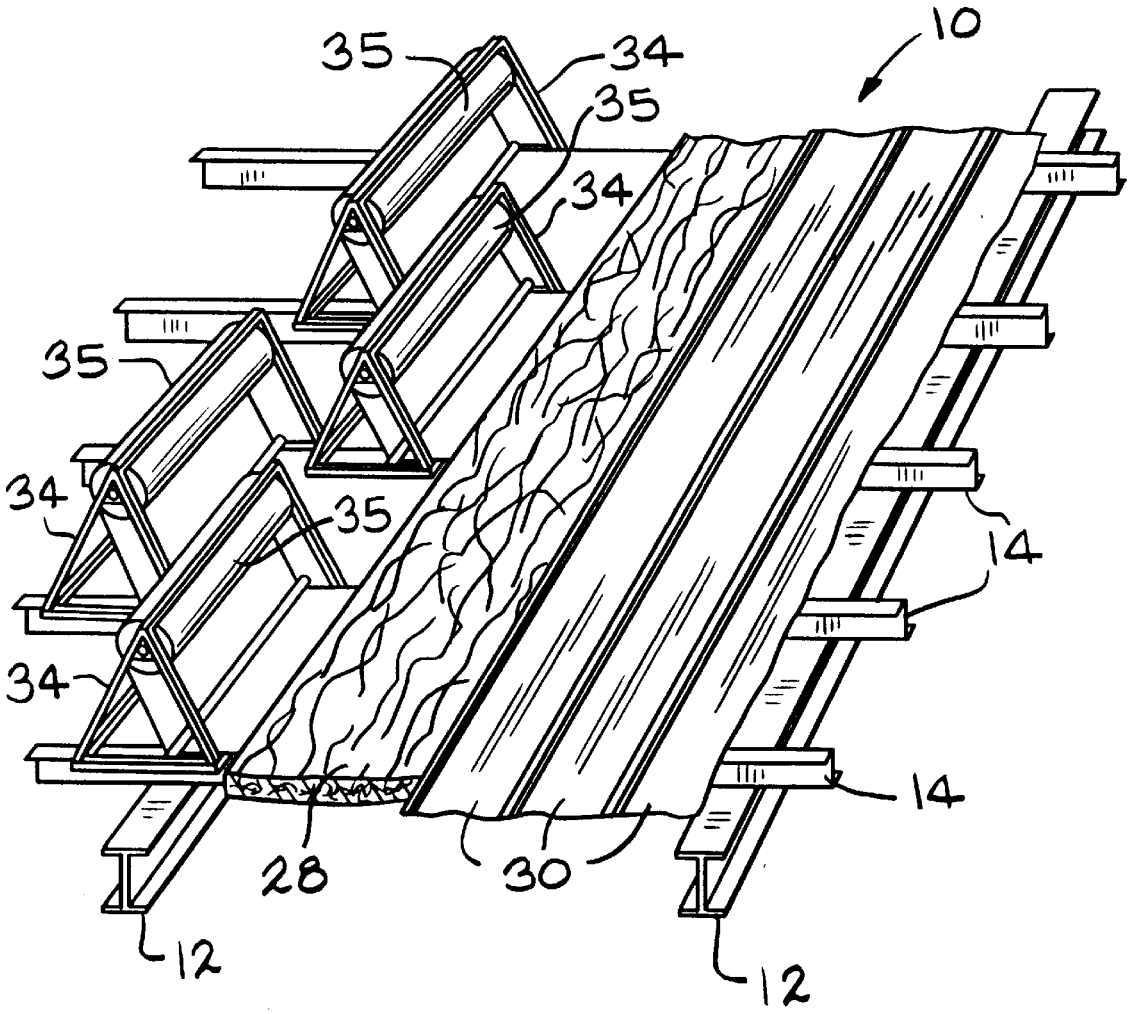
FIG. 2 PRIOR ART
FIG. 2 is perspective view of a plurality of prior art carriages positioned on top of a roof structure.

Referring to FIG. 2, a prior art method of building a roof structure 10 includes having a plurality of single carriages 34 which are each moved independently of one another in the first direction. Each carriage carries a support sheet roll 35 which is dispensed from the carriage. Because the carriages ride along the top of the purlins the carriages must be positioned on the purlins in a staggered fashion. This staggering is undesirable because of the lack of wind blockage, which will be discussed in greater detail below.

Figure 3:
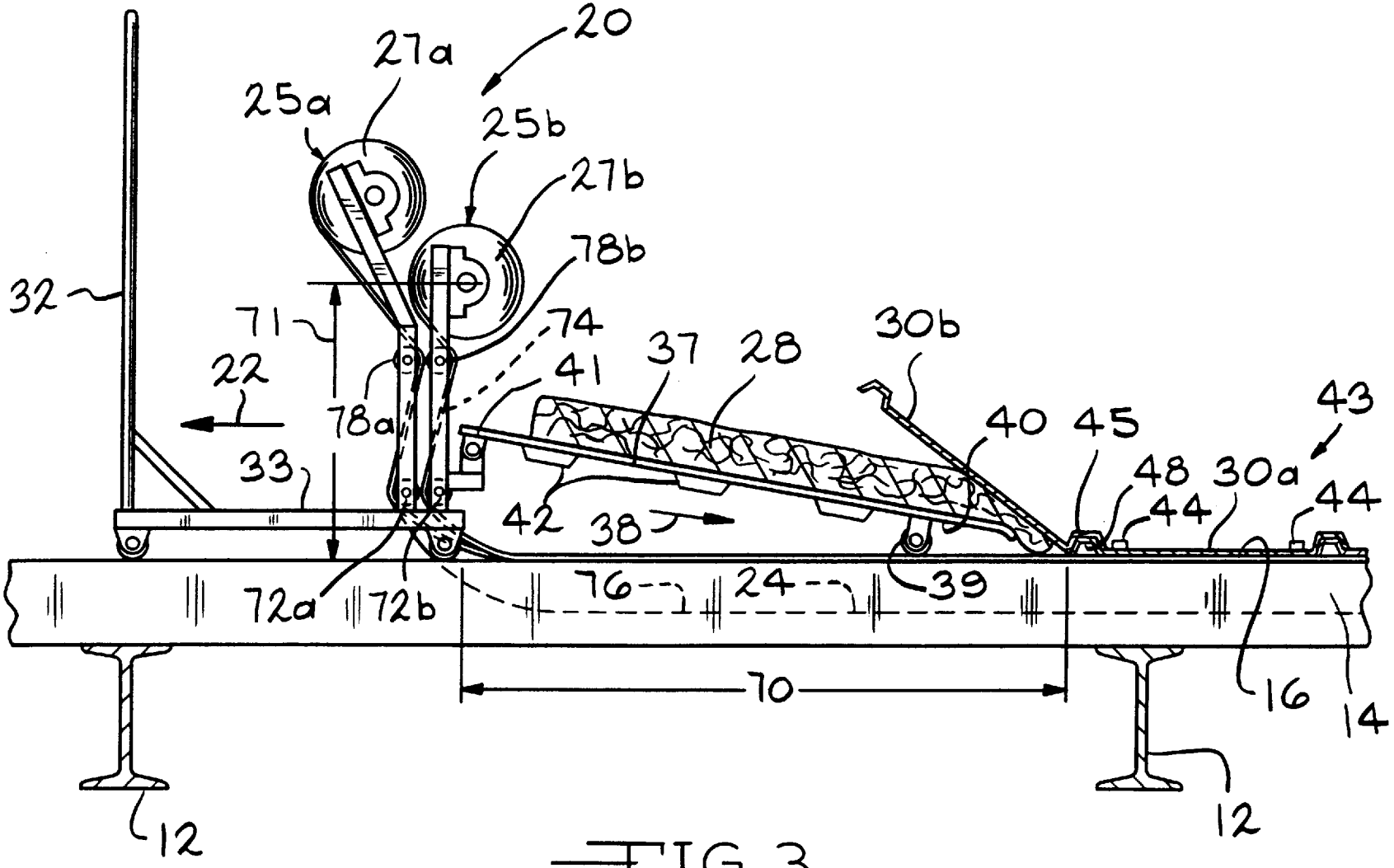
FIG. 3 is a side elevational view of the carriage of FIG. 1.

As can be seen in FIG. 3, a wind barrier 37 is provided and is preferably attached to the carriage 20. The wind barrier is positioned in a generally horizontal position and extends outward from the carriage in a second direction 38, which is opposite the first direction. The wind barrier is provided to hinder wind from blowing vertically through the uncompleted roof structure. The wind barrier has rollers 39 which roll on the top portion of the purlins and are fastened to the wind barrier at a distal end 40. The other end 41 of the wind barrier is fastened to the carriage. The wind barrier can also be built so that it is sufficient for fall protection for the workers to prevent them from falling off the leading edge of the previously completed section of roof. For example, structural stiffeners such as channels 42 can be stamped in the wind barrier to provide improved structural strength.

FIG. 3 illustrates the method of building a roof structure of the present invention in greater detail. A portion of the completed roof section is generally indicated at 43. A sheet of hard roofing material, or roofing sheet 30*a*, is attached to the top portion 16 of the purlins 14 by fasteners 44. The carriage 20 is positioned in front of the completed section of roof 43, and is spaced apart from the completed roof section by a gap 70. A strip of insulation material 28 is temporarily laid on the wind barrier 37 in a lateral direction with respect to the purlins. An edge 45 of a roofing sheet 30*b* is hooked to an edge 48 of the previously fastened roofing sheet 30*a*. The unfastened roofing sheet 30*b* is then laid on top of the insulation. The carriage is then moved in the first direction 22 until the wind barrier is out from underneath the roofing sheet 30b. The roofing sheet 30*b* is then fastened to the top portion of the purlin, thus inserting the insulation on top of the support sheet and between the adjacent purlins. Another roofing sheet (not shown) is hooked to the roofing sheet 30*b* and the carriage is moved in the first direction until all of the insulation material is resting on the support sheet 24. The procedure is then repeated until the roof structure is completed.

Figure 4:
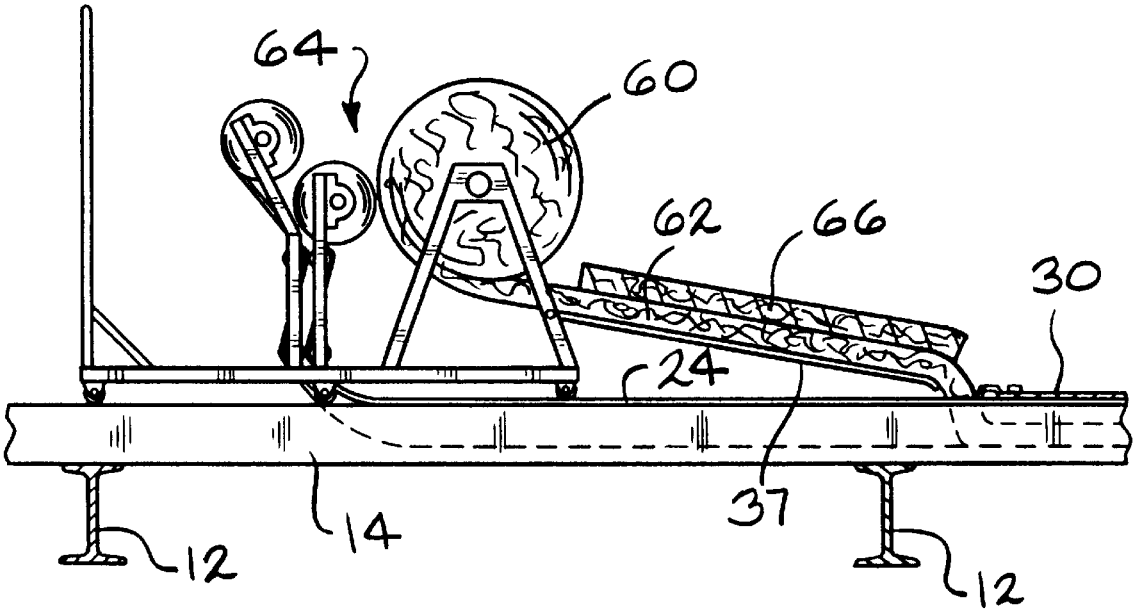
FIG. 4 is a side elevational view of an embodiment of the carriage dispensing a roll of insulation.

FIG. 4 illustrates another embodiment in which a roll 60 of insulation 62 is mounted on a carriage 64 so that the insulation is laid in a direction parallel to the purlins. A second layer of insulation 66 may optionally be laid laterally across the purlins so that a double layer of insulation is applied to the roof structure. The hard roofing material 30, or roof decking, is fastened in the same manner as described above.

Figure 5:
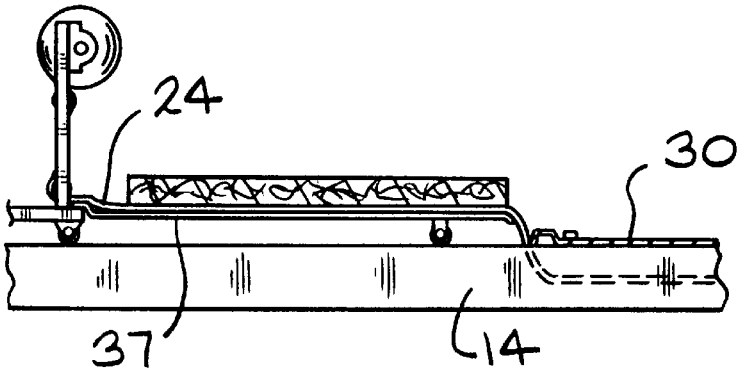
FIG. 5 is partial side elevational view of the wind barrier positioned underneath the support sheet.

Although it has been described and shown that the wind barrier 37 is positioned above the payed out support sheet 24, the wind barrier can be positioned below the support sheet, as can be seen in FIG. 5. The importance of the wind barrier is to prevent wind from blowing in a vertical direction through the gap 70 defined as the space between the just completed section of the roof and the carriage. The gap can be seen in FIG. 3 and is preferably approximately equal to the width of the insulation material because the carriage is not normally positioned farther away from the roof than the width of the insulation. Without the wind barrier, wind would be free to travel vertically through the gap and disturb the support sheet and insulation material. Wind can hamper or even prevent the workers from building the roof structure. For instance, using the prior art method shown in FIG. 2 or not using any carriage assembly at all, a 15–20 m.p.h. wind could blow the insulation out of position so that it would be nearly impossible to construct the roof efficiently. It is to be understood that the amount of wind tolerable in constructing roof structures is partially dependent on the wind direction as well as speed.

In another feature of the invention, the carriage is constructed so that the support sheet, which is dispensed from the dispenser, acts to prevent wind from blowing horizontally in a direction along the length of the purlins and through a vertical space 71 defined as the area between the dispenser and the purlins. As can be seen from FIG. 3, the leading dispenser 25*a* and the trailing dispenser 25*b* each have turning bars 72*a* and 72*b*, respectively, which extend in a direction across the support sheet and are positioned near the bottom of the vertical space. The turning bars turn the support sheet so that the support sheet forms a generally vertical portion 74 and a generally horizontal portion 76. The horizontal portion of the support sheet supports the insulation placed on top of the support sheet, and the vertical portion of the support sheet blocks wind from blowing horizontally through the vertical space. The support sheet roll portion 27 of the dispenser 25 is positioned substantially above the purlins so that a sufficient amount of wind can be blocked. If the dispenser is too low, the wind blowing over the dispenser can move or disturb the insulation support sheet. The dispenser is preferably positioned above the purlins by a distance greater than 24 inches.

It is important to align the vertical portions of the support sheet from adjacent dispensers, to create an effective wind barrier to prevent or at least hinder wind from blowing horizontally in a direction along the length of the purlins. For this purpose, deflection bars 78*a* and 78*b* are mounted on the dispenser and positioned between the turning bars 72*a* and 72*b* and the dispenser support sheet roll 27. The deflection bars deflect the vertical portion of the support sheet to align the vertical portions of adjacent carriage sections in a generally co-planar orientation. Preferably, the deflection bars are positioned near the top of the vertical space so that a substantial part of the vertical portions is in a generally vertical plane for best wind protection from a horizontally blowing wind. The turning bars, deflection bars and dispensers are all preferably spaced relatively close to each other so that the vertical portions of the support sheets will be relatively close together to prevent or hinder wind from blowing through the spaces between adjacent vertical portions of the support sheets. The adjacent turning bars should be spaced apart from each other by a distance less than about 3 inches so that they are generally co-linear on centers. Likewise, the deflection bars should be spaced apart from each other by a distance less than about 8 inches. Also, the dispensers are preferably spaced apart from each other by a distance less than 18 inches. The closer the adjacent turning bars, deflection bars and dispensers are to each other, the greater the wind blockage.

The wind barrier and the vertical portion of the support sheet combine to create an effective wind deterrent. With the prior art method shown in FIG. 2, a 15–20 m.p.h. wind could blow the insulation out of position so that it would be nearly impossible to construct the roof correctly. The prior art carriages ride along the top of the purlins the carriages and must be positioned on the purlins in a staggered fashion and, therefore, the carriages do not create a wind barrier for a horizontal wind blowing in the direction along the purlins. The present method of invention can be used effectively with winds of up to 30 to 40 m.p.h., depending on the direction of the wind and the occurrence of high gust winds. Therefore, the method of the present invention is effective to increase the general working wind limits for installing a roof structure.

It will be evident from the foregoing that various modifications can be made to this invention. Such, however, are considered as being within the scope of the invention.

INDUSTRIAL APPLICABILITY

The invention can be useful in the construction of roof structures for metal buildings.

We claim:

1. A method for providing a roof structure of the type having a plurality of purlins spaced apart from one another in a parallel arrangement comprising:

a. completing a first section of the roof structure comprising purlins, a support sheet, insulation material, and hard roofing material;

b. moving a carriage in a first direction along the length of the purlins and away from the first section of the roof structure to define a gap between the completed first section and the carriage, where moving the carriage pays out a support sheet from the carriage so that the support sheet depends from adjacent purlins in the gap; and c. positioning a wind barrier, attached to the carriage and extending in a second direction opposite the first direction towards the first section of the roof structure, in the gap to prevent wind from blowing vertically through the gap, and applying a layer of insulation material above said wind barrier thereby the wind barrier hindering wind disturbance of the support sheet and the insulation material.

2. The method of claim 1 including applying the insulation material above the support sheet, in the gap, where the wind barrier is sufficient to hinder wind disturbance of the insulation material.

3. The method of claim 2 in which the insulation material is laid laterally across the purlins, and in which the gap is substantially equal to the width of the insulation material.

4. The method of claim 2 in which the insulation material is dispensed from a roll which is mounted on the carriage, the insulation material being applied in a direction parallel to the purlins.

5. The method of claim 1 in which the wind barrier is positioned above the payed out support sheet.

6. The method of claim 1 in which the wind barrier is positioned underneath the payed out support sheet.

7. The method of claim 1 in which the wind barrier has rollers which roll along the top of the purlins.

8. The method of claim 1 in which the wind barrier is sufficient for fall protection.

9. The method of claim 1 in which the carriage has a plurality of carriage sections and support sheets, where the support sheets are payed out downwardly from dispensers mounted on the carriage sections and positioned substantially above the purlins to define a vertical space between the dispensers and the purlins, thereby forming vertical portions in the support sheets, the method further comprising:

a. aligning the vertical portions of the support sheets from adjacent dispensers to prevent wind from blowing horizontally in a direction along the length of the purlins through the vertical space;

b. feeding the support sheets around turning bars positioned near the bottom of the vertical space to turn the support sheets in a generally horizontal direction; and c. applying the insulation material above the horizontal portions of the support sheets, where the vertical portions of the support sheets are sufficient to hinder wind disturbance of the insulation material.

10. The method of claims 1, wherein the wind barrier is positioned above the plurality of purlins.

11. A method for providing a roof structure of the type having a plurality of purlins spaced apart from one another in a parallel arrangement comprising:

a. completing a first section of the roof structure comprising purlins, a support sheet, insulation material, and hard roofing material;

b. moving a carriage in a first direction along the length of the purlins and away from the first section of the roof structure to define a gap between the completed first section and the carriage, where moving the carriage pays out a support sheet from the carriage so that the support sheet depends from adjacent purlins in the gap;

c. positioning a wind barrier, attached to the carriage and extending in a second direction opposite the first direction towards the first section of the roof structure, in the gap to prevent wind from blowing vertically through the gap, thereby hindering wind disturbance of the support sheet;

d. Positioning a first layer of insulation material above the wind barrier; and e. applying the first layer of insulation material parallel to the purlins, above the support sheet, and in the gap, and applying a second layer of insulation material on top of the first layer of insulation material, where the wind barrier is sufficient to hinder wind disturbance of the insulation material.

12. The method of claim 11 comprising applying hard roofing material on top of the second layer of insulation material before the wind barrier is moved from the gap.

13. The method of claim 11 in which the second layer of insulation material is laid laterally across the purlins, and in which the gap is substantially equal to the width of the insulation material.

14. The method of claim 11 in which the wind barrier is sufficient for fall protection.

15. The method of claim 11, wherein the wind barrier is positioned above the plurality of purlins.

16. A method for providing a roof structure of the type having a plurality of purlins spaced apart from one another in a parallel arrangement comprising:

a. providing a plurality of carriage sections mounted for movement in a first direction to pay out support sheets so that the support sheets depend from adjacent purlins and extend parallel to the length of the purlins, where the carriage sections include dispensers for paying out the support sheets, where the dispensers are positioned substantially above the purlins to define a vertical space between the dispensers and the purlins;

b. paying out the support sheets downwardly from the dispensers, thereby forming vertical portions in the support sheets; and c. aligning the vertical portions of adjacent support sheets in a generally co-planar orientation to hinder the wind from blowing horizontally in a direction along the length of the purlins through the vertical space;

d. feeding the support sheets around turning bars positioned near the bottom of the vertical space to turn the support sheets in a generally horizontal direction so that the support sheets form horizontal portions; and e. applying insulation material above the horizontal portions of the support sheets, where the vertical portions of the support sheets are sufficient to hinder wind disturbance of the insulation material.

17. The method of claim 16 in which adjacent turning bars on adjacent carriage sections are generally co-linear.

18. The method of claim 17 in which the turning bars are spaced apart from each other by a distance less than about 3 inches.

19. The method of claim 16 in which the carriage sections have deflection bars being positioned near the top of the vertical space.

20. The method of claim 16 in which the carriage sections have deflection bars being spaced apart from each other by a distance less than about 8 inches.

21. The method of claim 16 in which the dispensers are spaced apart from each other by a distance less than about 18 inches.

22. The method of claim 16 in which the step of applying insulation material comprises applying a first layer of insulation material above the support sheet and parallel to the purlins, and applying a second layer of insulation material laid laterally on top of the first layer of insulation material.

23. The method of claim 16 where the plurality of carriage sections are moved together in unison in the first direction.

* * * * *